US006986310B2

(12) United States Patent
Calfas et al.

(10) Patent No.: US 6,986,310 B2
(45) Date of Patent: Jan. 17, 2006

(54) TRANSPORTER FOR VERTICAL MOVEMENT AND LATERAL TRANSFER OF PERSONS HAVING IMPAIRED OR NO SELF-LOCOMOTION

(76) Inventors: William Calfas, 835 Toulon Dr., Pacific Palisades, CA (US) 90272; Karin A. Calfas, 835 Toulon Dr., Pacific Palisades, CA (US) 90272

( * ) Notice: Subject to any disclaimer, the term of this patent is extended or adjusted under 35 U.S.C. 154(b) by 70 days.

(21) Appl. No.: 10/618,871

(22) Filed: Jul. 14, 2003

(65) Prior Publication Data

US 2005/0012288 A1 Jan. 20, 2005

(51) Int. Cl.
*A47B 9/00* (2006.01)

(52) U.S. Cl. ..... 108/147; 280/647; 297/DIG. 4

(58) Field of Classification Search ..... 280/647, 280/648, 657, 250.1, 304.1, 643, 47.33, 42, 280/638, 658, 47.38, 47.41; 254/7 C, 7 R; 297/DIG. 4, 68, 90, 91, 71, 64, 80, 85; 414/678, 414/680, 754, 778; 108/147
See application file for complete search history.

(56) References Cited

U.S. PATENT DOCUMENTS

| | | | | |
|---|---|---|---|---|
| 5,050,899 | A * | 9/1991 | Stensby | 280/250.1 |
| 5,179,745 | A * | 1/1993 | Hebert et al. | 5/620 |
| 5,427,337 | A * | 6/1995 | Biggs | 248/15.7 |
| 5,601,302 | A * | 2/1997 | Beard et al. | 280/250.1 |
| 5,669,620 | A * | 9/1997 | Robbins | 280/250.1 |
| 5,690,185 | A * | 11/1997 | Sengel | 180/65.1 |
| 6,247,718 | B1 * | 6/2001 | Gobbers et al. | 280/304.1 |
| 6,474,665 | B1 * | 11/2002 | Fink et al. | 280/79.2 |
| 6,540,250 | B1 * | 4/2003 | Peterson | 280/657 |
| 6,692,011 | B2 * | 2/2004 | Carlson et al. | 280/79.2 |
| 6,874,432 | B2 * | 4/2005 | Lanphear | 108/147 |

* cited by examiner

*Primary Examiner*—J. Allen Shriver

(57) ABSTRACT

A transporter to assist the movement of an impaired person. The transporter is movable on casters along a floor, and includes a top surface on which the person rests. This surface is smooth to facilitate sliding the person on and off, and vertically movable under power to raise and lower the person without personal effort.

13 Claims, 2 Drawing Sheets

TRANSPORTER FOR VERTICAL MOVEMENT AND LATERAL TRANSFER OF PERSONS HAVING IMPAIRED OR NO SELF-LOCOMOTION

FIELD OF THE INVENTION

A transporter for raising and lowering persons having impaired or no self-locomotion, and enabling their lateral transfer such as between a wheelchair or bed, an examination table, or an X-ray table.

BACKGROUND OF THE INVENTION

Persons having impaired or no self-locomotion face many difficulties and impediments to receiving adequate medical and custodial care. Examples are persons with spinal injuries that deprive them of the use of their legs. In addition to these widely-recognized causes, there are many others, such as the gradual loss of power to the extremities of persons with multiple sclerosis. Persons dependent on walkers, or those with insufficient voluntary control such as Alzheimer patients may still have some control, but so little as to render them incapable of substantial voluntary movement needed to place themselves in some desired but inconvenient location.

The fact that there are so many such causes and so many involved persons is attested by the large number of wheel chairs and assistance devices which are sold each year. Persons not encumbered by these disadvantages may readily conclude from their own observations that the problems are largely those of passing through portals, fitting into restrooms, and getting onto and off of public conveyances. These are certainly real, and are known principally because they are so much in the face of mobile people who use or occupy the same spaces and facilities. As serious as these are, they represent the more hopeful side of the situation, because they are seen and have attracted solutions.

There is, however, a sadder and quieter side that, because it occurs out of sight and much less frequently, is looked past. These are not totally ignored, but they are not widely seen, and they are not public enough to cause a public outcry. And what is worse, the help that can be given by others societally and personally is inherently limited, and the cost of amelioration with the use of presently-known equipment is too high for many or most individuals to afford.

This invention relates to such a "niche" in the world of persons with impaired or no capacity to move themselves sufficiently. Persons whose limbs cannot respond forcefully to commands are known to be inherently exposed to harm from falls. It is less recognized that even greater harm can result from the handling of these people who have fallen. After a fall, a 911 call will bring a helpful, muscular group of fine men who can readily lift the weight of the person, but who can just as readily break their ribs while they carefully squeeze and lift the person.

Less stressful occasions are nearly as harmful, for example when custodial people lift a fallen person, or transfer one from a bed to a chair. Here both persons are placed at risk. Often it requires two or more people to do this task, which is inherently clumsy. As a consequence a large number of accidents occur, not only to the person, but to those lifting the person. As a consequence workers compensation insurance rates are very high, and often employees will refuse to lift or transfer an impaired person except when absolutely necessary, and at least risk to themselves. Accordingly, they minimize handlings such as transfer from bed to chair, especially when a lift is needed, along with a lateral movement.

There is a set of situations which occur quietly, out of general sight, and usually in private which are not urgent, but which in the long run may result in even greater discomfort and ultimate damage. Surprisingly, these occur in the unlikeliest of places—where succor would most be expected—for example in care facilities, especially hospitals and doctors offices.

Here, when a patient arrives in a wheelchair there are no more than the usual objections or problems in receiving the person being wheeled in, while the person remains in the wheelchair. No problem in the waiting room, and no problem for conversational and superficial examinations, nor of routine testings, such as blood withdrawal.

Instead, the principal, but not the only, situation attended to by this invention arises from the need to examine the body and the insides of an impaired person. For this, one must recognize that square footage in hospitals and doctors offices is scarce and costly. A doctor requires several examination rooms so that he can attend to the needs of several patients in an economical time frame. These rooms need contain only an examination table and enough room for him to move around in it.

An X-ray room needs only space for the equipment and space at one side to load and unload the patient on the table. Any more is wasteful and unnecessary.

In normal practice, an ambulatory person walks or is wheeled into any of the above rooms and stretches out on the table. No problem there. But if that person is not fully responsive and capable of assistance or self-locomotion, he or she must somehow be lifted onto the table with all of the risks discussed above which involve lifting the person onto the table, then the situation is entirely different.

The hospital or the doctor must now factor into the situation all of the costs and risks to place that person in a location where the task can be done correctly. This can be done if all parties take the above risks. Instead, it is surprisingly customary for many internal examinations and even X-rays to be taken while the patient remains in the wheelchair. There are women who have never had a complete gynological examination, or a pap smear or a mammogram because they were examined in the wheelchair—never while on a proper examination table or device where they could properly be viewed.

Too often even routine examinations, regularly given to others, are not performed at all. The insufficiency of these procedures has recently been called into question, because they clearly reflect the giving of services to a degree to disabled persons far below that attainable with the same equipment provided that a person is properly positioned on it. Statutes exist, such as California's Unruh act, which proscribe such situations, but they remain commonplace in the absence of some realistic solution.

It is unfair to cite the hospitals and doctors for this. Their workers compensation insurance rates and office rents are far higher than for most comparable services. Existing equipment that could assist is bulky and very expensive. For example, examination tables and X-rays tables do exist that raise and lower. These are much more costly than those which do not. How can the individual doctor afford these? And must he provide these when so few, if any, of his patients would require them? Economics say no. So except for large clinics, specialized equipment for the transport of physically impaired people is simply not provided, and patients receive less care than if they could safely be placed on a proper surface, or if the doctor risks harming them while attempting to help them.

While silent and private, such situations are not the less saddening or frightening to the involved person. But because they are so private, they have called for no public solution, and are unlikely to obtain one societally. Accordingly, it becomes the task of concerned inventors and companies to provide an acceptable, affordable, and above all, a dignified means to attend to them.

It is an object of this invention to provide a small, portable, inexpensive device to receive a person laterally without raising or lowering him or her, and then to raise or lower him or her to a desired elevation, and then facilitate the lateral movement of the person to a next surface, such as to an examination table, an X-ray table or a chair. All vertical movement is powered, and all lateral movement is done without vertical movement of the person, only a sliding movement that can readily be safely attended to. It is well-recognized that it is much more difficult to raise a person than to move him or her side wise, or to lower the person. The transport provided by this invention will be safe for all involved persons.

BRIEF DESCRIPTIONS OF THE INVENTION

Apparatus according to this invention includes a mobile base, a cap with a smooth top surface, and a jack between the base and the cap. The cap depends downwardly in the manner of an inverted cup over the upper part of the base. The base carries guides along which the cap slides as it moves vertically when the jack is actuated. The sidewall of the cap surrounds the upper part of the base without pinch points that could catch and injure the hands.

According to a preferred but optional feature of the invention, a stabilizer is provided to stabilize the position of a person on the top surface so he or she will not slide off. Such a stabilizer may be a belt, a removable rail, or some other type of restraint removably attachable to the cap.

The above and other features of this invention will be fully understood from the following detailed description and the accompanying drawings, in which:

DETAILED DESCRIPTION OF THE INVENTION

Figure 2:
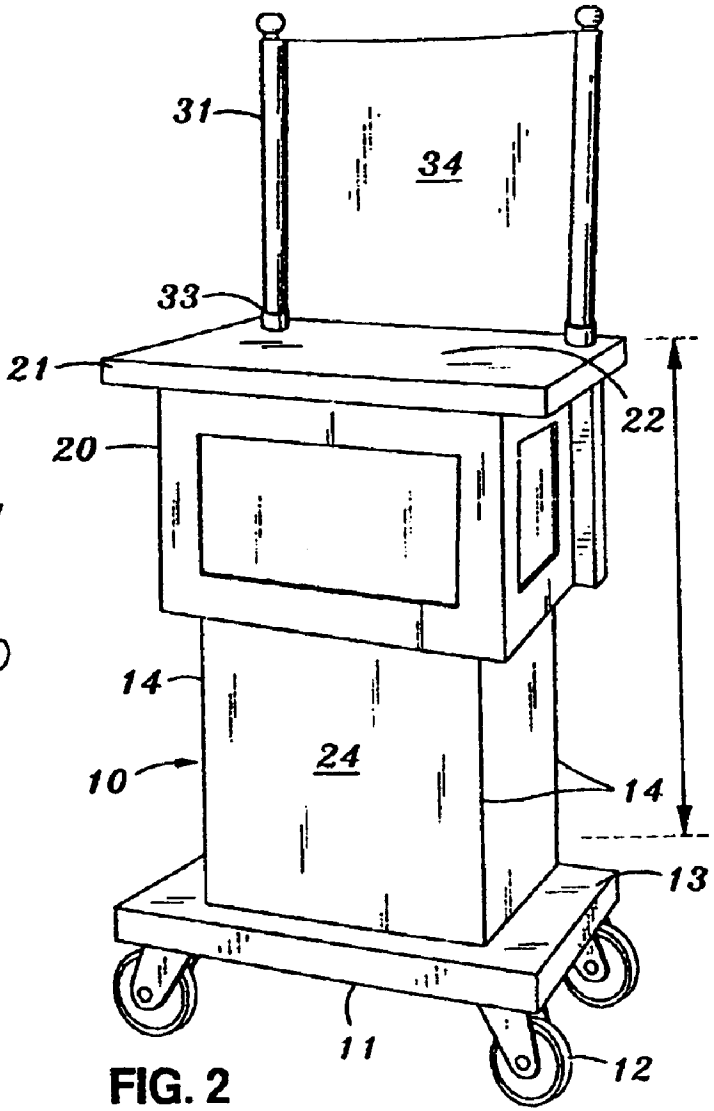
FIG. 2 is a similar view with the transporter in an elevated position.
Figure 1:
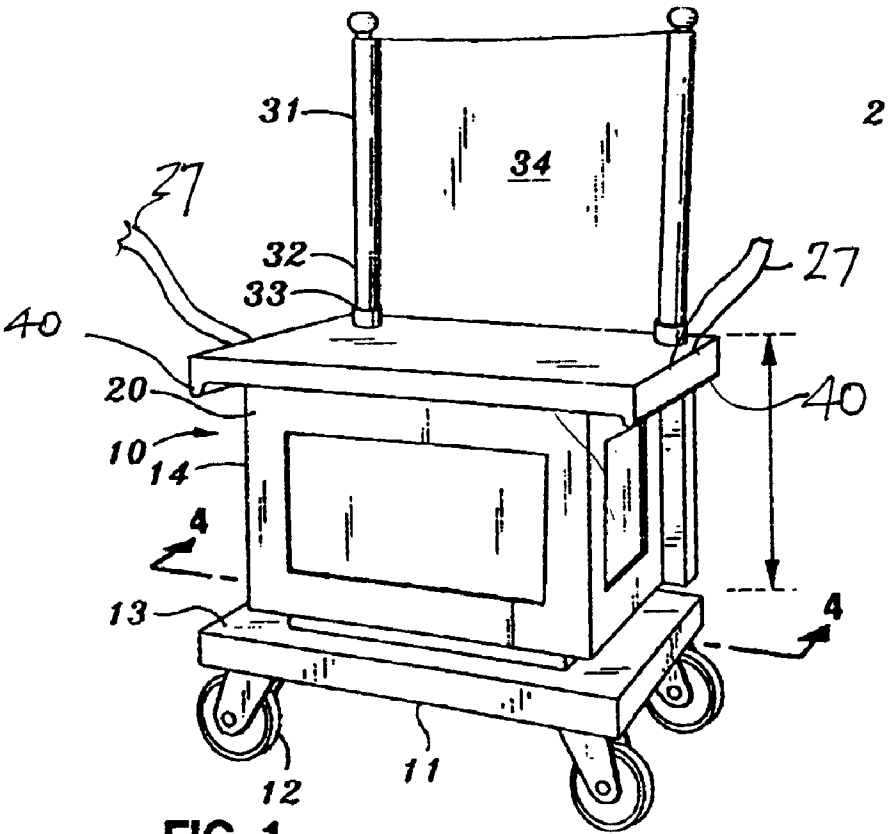
FIG. 1 is a perspective view of the invention in a lowered position.
Figure 4:
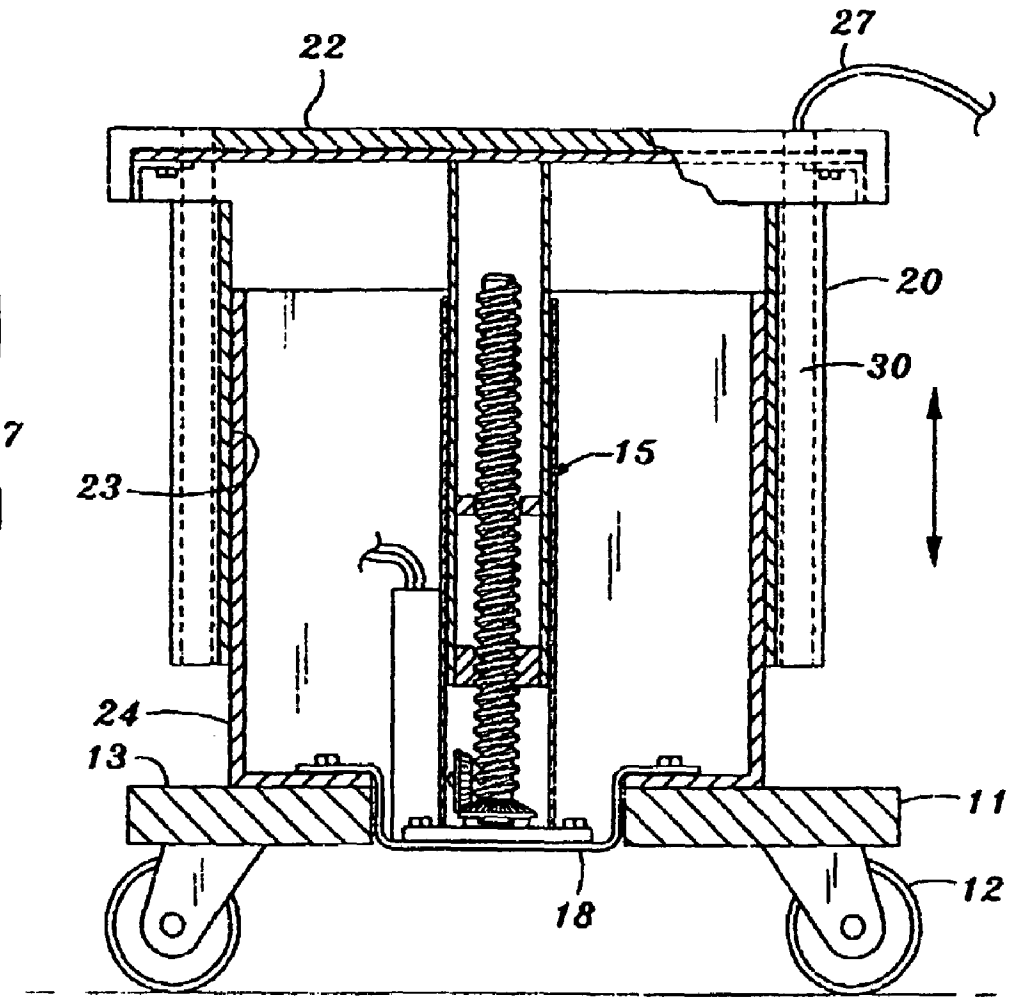
FIG. 4 is a cross-section taken at line 4—4 in FIG. 1.
Figure 3:
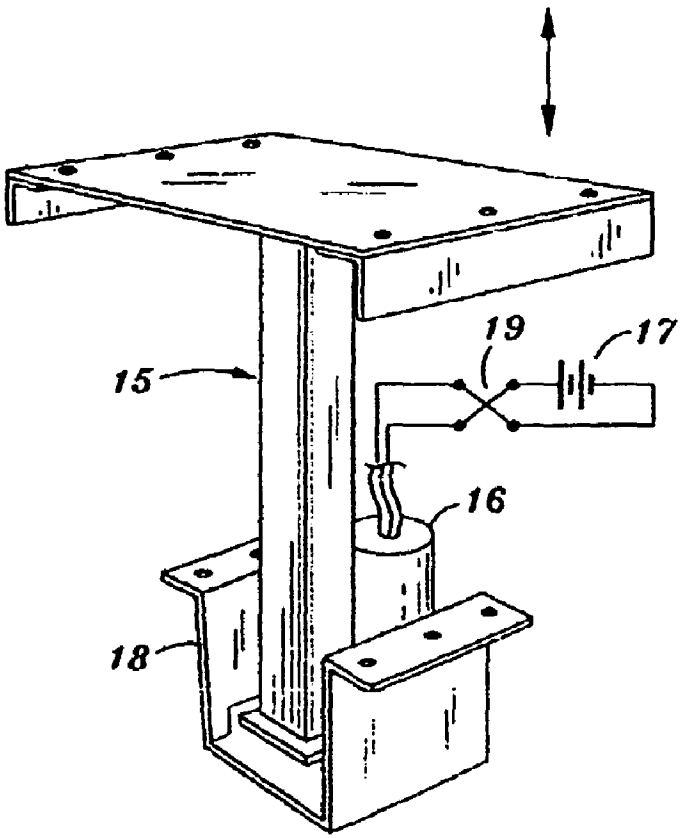
FIG. 3 is a detail view of a portion of the invention.

A transporter 10 according to this invention is shown in FIG. 1. Its purpose is to receive a person from a table, gurney, wheelchair, walker, or other structure, raise or lower him or her to the elevation of a next surface, and facilitate the movement of the person to a next surface.

The transporter includes a base 11 which is made mobile by casters or wheels 12 on which it rests. These may be steerable or universally freely turnable as desired so as, readily to be movable around the room. Any suitable type of brake or restraint may be provided to lock the base against movement when appropriate.

Base 11 includes a central platform 13 which supports vertical guides 14. It also supports a jack 15, which may for example be a screw type, or even a hydraulic piston-cylinder type. A screw type will be preferred. It is readily powered by a bi-directional motor 16 that receives power from a source of electricity such as a battery 17.

To minimize the bulk of the transport, the jack is mounted to the base by a U-shaped mounting bracket 18 that places the base of the jack as close to the floor as possible.

A bi-directional and off-on switch 19 determines the direction of operation of the jack by determining which direction the motor is to turn. It also includes a "stop" position. The jack will preferably be self-locking so that a weight on it will not cause movement of the jack. Only operation of the motor will cause the jack to move. If the jack is a screw type, a screw with a locking angle will be used. Otherwise a brake will be provided.

A cap 20 includes a support 21 with a top surface 22 which extends beyond the guides. It has a sidewall 23 that depends downwardly from the support. The base preferably includes sidewall 24 that rises inside sidewall 23 in a telescopic manner. The cap therefore depends downwardly, much as an inverted cup. The sidewalls enclose all moving parts, and are closely fitted so as to exclude fingers, forming no pinch regions.

Top surface 22 is planar, and preferably is quite smooth. Smoothness enables a person to slide (or to be slid) along this surface, so that the weight of the person need not be lifted. Lateral movement of a person is a simple matter, requiring at most some modest support while the person moves from some next surface at the same elevation.

It will be prudent, although not essential, to provide a stabilizer to hold the person on the top surface while the transporter is being moved with the person atop it. A separable belt 27 attached to the transporter may be adequate.

However, a more robust and versatile stabilizer may be preferred which offers lateral support. For this purpose, sockets 30 may be formed in support 21. Stakes 31 may be inserted in these sockets with a portion 32 projecting above the top surface. A collar 33 on the stake will limit its insertion into the socket. A web 34 may be stretched between adjacent stakes to provide a gentle restraint, and may even form a backrest against which the person can lean.

Usually the person's legs will hang over the edge of the support. A sitting position then may be preferred. The legs are readily lifted when the person is to be moved without much effort.

It will be noted that this is not a large cumbersome piece of furniture. A top surface about 30 inches square will usually be more than ample. Surfaces as small as 17 inches by 22 inches will fill many needs. The range of elevations above floor will ordinarily be between about 20 and 32 inches. Only a range of about 12 inches for elevation change is usually sufficient, although it can be more or less.

This device can be moved from room to room, can pass through standard doorways, and can fit in available spaces in small existing rooms. It can be finished as an attractive piece of furniture, or made of metal and plastic as desired.

As an additional assurance to the transported person, a depending lip 40 (shown only in FIG. 1) may be formed at two opposite edges of the top surface. The person is thereby given a means to hold on to the transporter with his or her hands.

This device thereby enables the transport of persons from one structure to another, with accompanying changes of elevation made without physical effort. It makes available to this group of people facilities for examination and treatment now denied to them.

This invention is not to be limited by the embodiment shown in the drawings and described in the description, which is given by way of example and not of limitation, but only in accordance with the scope of the appended claims.

What is claimed is:

1. A transporter to facilitate the movement of a person having impaired or no self-locomotion from a location at a first elevation and location to a laterally spaced-apart location at a higher or lower elevation, comprising:

a base having a recessed portion, a horizontal orientation and a vertical axis;

wheels enabling said base to be moved in said horizontal orientation in any lateral direction relative to said vertical axis, said wheels being freely rotatable around axes parallel to said vertical axis and spaced therefrom;

a platform having an upper surface normal to said axis said surface being planar, smooth, and devoid of any protrusion above said upper surface;

a jack mounted to the recessed portion of said base and below said platform, extending between them so as to enable and power the selective raising or lowering of the platform relative to the base, said jack including a threaded screw having a locking characteristic, whereby to prevent lowering of the platform by its weight and by its weight combined with a load on it, except when the screw is positively turned;

a power source to activate said jack by turning the screw;

a control to enable actuation of said jack by said power source, whereby said transporter can be moved adjacent to a place where a person is supported, raised or lowered so as slidably to receive said person, wheeled to another location, then raised or lowered to permit the person to be slided onto another place.

2. A transporter according to claim 1 in which said planar surface includes a socket and a removable support, said support being insertable into said socket to limit the sliding movement of a person being slidably moved on said surface.

3. A transporter according to claim 1 in which a lip depends below said upper surface, for a person to grasp.

4. A transporter according claim 1 in which a peripheral skirt is attached to said platform, extending downwardly to enclose said jack, being movable upwardly and downwardly with said platform to shroud said jack from outside contact.

5. A transporter according to claim 4 in which said planar surface includes a socket and a removable support, said support being insertable into said socket to limit the sliding movement of a person being slidably moved on said surface.

6. A transporter according to claim 5 in which a lip depends below said upper surface, for a person to grasp.

7. A transporter to facilitate the upward and lateral movement of a person, the transporter comprising:

a base;

a plurality of wheels associated with the base such that the base may be moved in any lateral direction;

a laterally extending platform having a substantially smooth upper surface;

a jack, mounted between the base and the platform, adapted to move the platform upwardly and downwardly relative to the base, and including a threaded screw that prevents lowering of the platform by its weight and by its weight combined with a load on it unless positively turned;

a telescoping enclosure including a first member extending upwardly from the base and defining a first member perimeter that extends around the jack, and a second member extending downwardly from the platform over the first member and defining a second member perimeter that extends around the first member;

a power source adapted to turn the screw; and a control adapted to actuate the power source.

8. A transporter as claimed in claim 7, wherein the platform defines a platform perimeter and the telescoping enclosure occupies a substantial majority of a volume having a perimeter corresponding to the platform perimeter and extending from the base to the platform.

9. A transporter as claimed in claim 7, wherein the first member includes four vertically extending walls and the second member includes four vertically extending walls.

10. A transporter as claimed in claim 7, wherein the platform defines a platform perimeter and the second member perimeter is smaller than the platform perimeter.

11. A transporter as claimed in claim 7, wherein the wheels are freely rotatable about respective vertical axes.

12. A transporter as claimed in claim 7, wherein the platform includes a planar upper surface devoid of protrusions.

13. A transporter as claimed in claim 7, further comprising:

means, removably associated with the platform, for restraining movement of a person seated on the platform in at least one direction.

* * * * *